US006719595B1

(12) United States Patent
Welcker

(10) Patent No.: US 6,719,595 B1
(45) Date of Patent: Apr. 13, 2004

(54) BATTERY TERMINAL CONNECTION CABLE

(75) Inventor: Friedrich Welcker, Hagen-Hohenlimburg (DE)

(73) Assignee: Bernhard Fröhlich, Osterode (DE)

( * ) Notice: Subject to any disclaimer, the term of this patent is extended or adjusted under 35 U.S.C. 154(b) by 0 days.

(21) Appl. No.: 09/744,820

(22) PCT Filed: Jul. 30, 1999

(86) PCT No.: PCT/DE99/02323

§ 371 (c)(1),
(2), (4) Date: Jan. 30, 2001

(87) PCT Pub. No.: WO00/08718

PCT Pub. Date: Feb. 17, 2000

(30) Foreign Application Priority Data

Aug. 1, 1998 (DE) ..... 198 34 792
Feb. 13, 1999 (DE) ..... 199 06 088

(51) Int. Cl.[7] ..... H01R 11/11; H01R 4/30

(52) U.S. Cl. ..... 439/883; 439/755

(58) Field of Search ..... 439/883, 775, 439/755, 762, 768

(56) References Cited

U.S. PATENT DOCUMENTS

| | | | | |
|---|---|---|---|---|
| 1,970,022 A | | 8/1934 | Pietenpol | 439/874 |
| 3,566,465 A | | 3/1971 | Wiener | 29/860 |
| 3,821,694 A | * | 6/1974 | Gottlieb | 439/755 |
| 4,049,335 A | | 9/1977 | Julian et al. | |
| 4,118,097 A | * | 10/1978 | Budnick | |
| 4,325,760 A | | 4/1982 | Julian et al. | 156/49 |
| 4,362,351 A | * | 12/1982 | Wible | 439/738 |
| 4,596,352 A | | 6/1986 | Knapp | |
| 4,598,971 A | * | 7/1986 | Goodman | 439/726 |
| 4,636,025 A | * | 1/1987 | Norris | 439/755 |

FOREIGN PATENT DOCUMENTS

| | | |
|---|---|---|
| DE | 7100634.3 | 4/1971 |
| DE | 2 249 707 | 4/1973 |
| DE | 22 50 836 | 4/1973 |
| DE | 3151151 | 12/1981 |
| DE | 3437749 | 10/1984 |
| DE | 33 45 617 | 1/1985 |
| DE | 38 38 825 | 5/1990 |
| DE | 90 13 380.3 | 11/1990 |
| DE | 42 10 202 | 9/1993 |
| EP | 0314319 | 10/1968 |
| EP | 0133883 | 8/1983 |
| EP | 0 671 790 | 9/1995 |
| EP | 0 707 321 | 4/1996 |
| FR | 2006123 | 12/1969 |
| FR | 2215707 | 1/1973 |
| FR | 2501923 | 3/1981 |
| GB | 2200068 | 12/1986 |
| GB | 2177336 | 1/1987 |

OTHER PUBLICATIONS

Niebuhr Ultraschall Schweissanlagen, Ultraschall–Metallschweissen.
"Advances in Wire Splicing and Termination", Ses. 25 Oct. 1992, M.J Patrikios, American Tech., Inc.
Ultrasonic Metal Welding, Schunk Ultraschall, Schunk Gruppe "Ultrasonic Welding Wire Termination", Saeed Mogadam, Stapla Ultrasonics Corp., MA.

(List continued on next page.)

*Primary Examiner*—Chandrika Prasad
(74) *Attorney, Agent, or Firm*—Collard & Roe, P.C.

(57) ABSTRACT

According to the invention, an at least partially insulated strand of a battery terminal connection cable is either welded to a contact piece using ultrasound or is welded with a contact piece. As a result, the contact piece can be fastened onto the battery terminal using a conventional screw without worrying about the screw becoming loose. The battery terminal connection cable can be produced in an easy and at least partially automated manner using a device which comprises a sonotrode, a strand feed device, a contact piece feed device, and a pressure cylinder.

5 Claims, 3 Drawing Sheets

OTHER PUBLICATIONS

"Ultrasonic Welding Wire Termination", Saeed Mogadam, Stapla Ultrasonics Corp., MA.

Interconnection Tech., Feb. 1994, IHS Group Pub.

"Ultrasonic Welding applications in Telecommunications", C.A. Shumake, Jr.

"Cost Effective Production of Power Supply Components Using Ultrasonic Bonding Techniques", Janet Devine, Sonobond Ultrasonics, PA.

"Ultrasonic Welding of Non–Ferrous Metals", Kodama, Ultrasonic Engineering, Welding Int'l 1989, No. 10.

"Ultrasonic Sound Off", Schwartz.

Stockel (1980) "Ultraschallschweissen in der Kontakttechnik" In: etz, Bd. 101, H. 18, S. 1000–1003.

Herrmann (1983) "Ultraschallgeschweisste Kabelanschlusse", In: Praktiker, S. 361–364, Bild 3.

* cited by examiner

BATTERY TERMINAL CONNECTION CABLE

CROSS REFERENCE TO RELATED APPLICATIONS

Applicants claim priority under 35 U.S.C. §119 of GERMAN Application No. 198 34 792.8 filed Aug. 1, 1998 and GERMAN Application No. 199 06 088.6 filed Feb. 13, 1999. Applicants also claim priority under 35 U.S.C. §120 of PCT/DE99/02323 filed on Jul. 30, 1999. The international application under PCT article 21 (2) was not published in English.

BACKGROUND OF THE INVENTION

The invention relates to a battery terminal connecting cable with a strand consisting of numerous fine wires and a further section having a hole for a screw, whereby on the further section the numerous fine wires are welded together, a method for the manufacture of a battery terminal connecting cable and a device for the manufacture of such a cable.

Battery terminal connecting cables are used primarily to interconnect battery cells conductively. In this case one also talks of cell connectors. For the conduction of relatively high currents at low electrical resistance the strand usually consists of copper wires twisted into a strand having a cross-section of approximately 50 $mm^2$. Depending on the field of application, however, both thicker and thinner strands are used.

In order to connect such a strand consisting of numerous fine copper wires to a battery terminal, a copper pipe section is first inverted over the strand and this pipe section is then pressed to an approximate plate shape. In this plate there is a hole which first passes through the upper side of the original pipe section, then through the compressed cable and finally through the lower side of the original pipe section. Finally in this hole there is inserted a screw which interacts with a thread in the battery terminal so that when the screw is tightened, the strand held together by means of the copper sleeving is pressed onto the battery terminal.

In practice it has been found that even a relatively strongly tightened screw works loose as a result of vibrations, as occur especially in batteries located in vehicles. This has the result that the end of the cable is no longer securely connected to the battery terminal. Contact is therefore made over smaller areas and is thus severely impaired. In cases of more severe loosening this leads to undesirable heating, even to the extent of sparking.

In order to prevent screws working loose, in known battery terminals a plastic section, such as preferably a plastic bead, is provided in the thread region between the screw and the battery terminal. This bead becomes deformed as the screw is turned and acts to prevent loosening of the screw.

The insertion of a bead or other plastic section has the result that expensive, special screws are required. Since battery terminal connectors are a mass-produced product manufactured in large quantities, any increase in the cost of the product leads to economic disadvantages.

A battery terminal connecting cable of appropriate type is known from EP-A-O 707 321. In practice the end of the cable strand produced by spot welding does not give the required strength values for the cable end so that the cables described have not proved suitable as battery terminal cables.

U.S. Pat. No. 4,325,760 discloses a cable whose end was soldered. However, soldering is an expensive procedure which leads to increased costs in the area of mass production.

The invention is based on the problem of preparing a connection between battery terminal connecting cable and battery terminal at a favourable cost, which ensures secure contact between the battery terminal connecting cable and the battery terminal even under severe vibration or thermal expansion.

The problem is solved using a battery terminal connecting cable of appropriate type where the strand is at least partly insulated and a further section is secured at the end of the strand.

SUMMARY

The invention is based on the knowledge that the problem of screw loosening in the battery terminal is not primarily attributable to the screw being held inadequately in the battery terminal. The reason for loosening screws lies in the fact that at times fairly high temperatures occur at the contact piece of the battery terminal connecting cable as a result of the flowing currents. At varying temperatures the fine wires inside the copper sleeving are severely compressed from time to time and then remain in this severely compressed form. As a result after many temperature fluctuations the originally tightened screw is subject to less force so that the screw sits more loosely in the thread. Loosening of the screw can then only be impeded by the plastic section described above. The plastic section certainly impedes loosening of the screw but the fact that the screw at times exerts less pressure on the contact piece is not impeded by the plastic section. However, a constant pressure on the contact piece is required to ensure a continuous equally good current flow.

Practical tests have shown that when a cable end consisting of wires welded together, is screwed on, the compression of the connecting piece described above does not occur and consequently normal screws without protection against loosening can be used. Since the screw now presses the contact piece onto the battery terminal at a constant pressure, optimal electrical conditions are created and thus the heating in the contact region is reduced.

According to the invention a further section is secured at the end the strand. This further section can, for example, serve as a contact piece and can be connected in various ways to the end of the strand welded to form a solid material.

A particularly preferred embodiment of a battery terminal connecting cable is obtained if the further section is welded onto the end of the strand. In this way a specially favourably shaped contact piece can be used. This in particular allows the weight of the battery terminal connecting cable to be reduced.

It is also advantageous if the further section, preferably constructed as a contact piece, is made of copper.

In all known battery terminal connecting cables the longitudinal axis of the further section extends in the direction of the axis of the battery terminal connecting cable. Since the battery terminal connecting cable serves as a connecting element between two terminals, it seems to be logical to use a further section extending in the direction of the axis of the battery terminal connecting cable. However, tests have shown that in many cases it is of great advantage if this further section is configured such that its longitudinal extension runs at an angle to the longitudinal axis of the cable. Examples of this type of configuration are shown in FIGS. 6–9.

Depending on the configuration of the battery terminals, in practice the connecting cables are frequently very severely bent. In many cases, the angular configuration of the further section to the axis of the battery terminal connecting cable reduces the necessary bending of the cable and also allows shorter cables to be used. The configuration described thus has the result that the cable can be protected and material usage can be reduced.

The angular configuration described is also of great importance for battery terminal connecting cables regardless of the afore-mentioned characteristics and can thus also be used to advantage for clamp connections between the cable strand and a further section.

The problem according to the invention is also solved using a method for the manufacture of a battery terminal connecting cable in which a strand consisting of numerous fine wires is welded by means of ultrasound and the strand is welded to a contact piece or with a contact piece.

The use of ultrasound for making electrical connections is already known from EP-A-0 671 790. However, the welding of the strand to a contact piece or with a contact piece cannot be inferred from this document.

All types of welding or soldering of an end of a strand developed so far have failed in that the high heat input during the welding process is transferred from the copper cables normally used to the insulating layer. On the one hand, this leads to destruction of the insulation and on the other, the input heat is rapidly dissipated. Only welding by means of ultrasound produced such good results that the insulating layer can remain on the cable strand during welding. This surprising result reduces the energy input and allows known manufacturing methods for moulding plastic onto the connecting regions to be used even for the new battery terminal connecting cable.

For manufacture of the battery terminal connecting cable according to the invention a device is proposed which has a sonotrode, a strand feed device, a contact piece feed device and a pressure cylinder arranged so that the strand and the contact piece can be pressed onto one another by means of this device.

The device allows the battery terminal connecting cable to be manufactured automatically and rapidly.

Since during pressing of the wire strand the fine wires are pressed to the side, it is proposed that on the device according to the invention there should preferably be provided movable jaws which act on the strand at right angles to the axis of the pressure cylinder. These jaws together with the pressure cylinder and the sonotrode define a cross-section in which the wires should be welded together to form the most compact copper piece. At the end of the welding process the jaws are moved away from the strand and the pressure cylinder is retracted so that the strand connected to the contact piece can be removed from the device.

An example of embodiment according to the invention is show in the drawing and will be explained in greater detail in the following.

DETAILED DESCRIPTION

Figure 1:
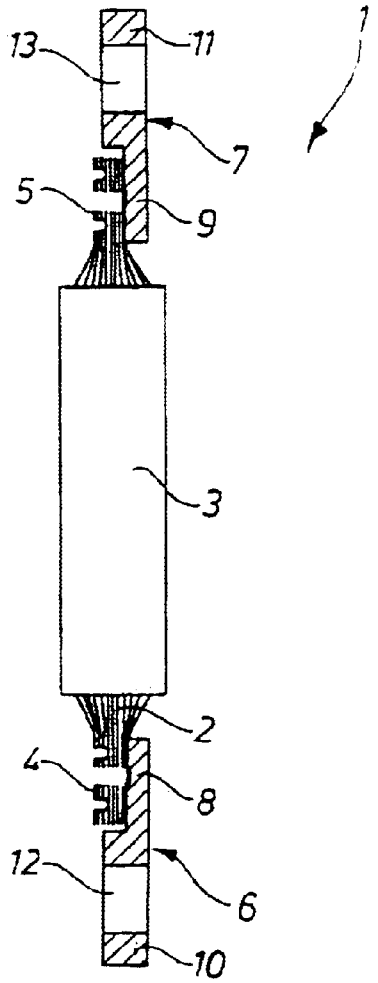
FIG. 1 is a side view of a battery terminal connecting cable without plastic sleeving.
Figure 2:
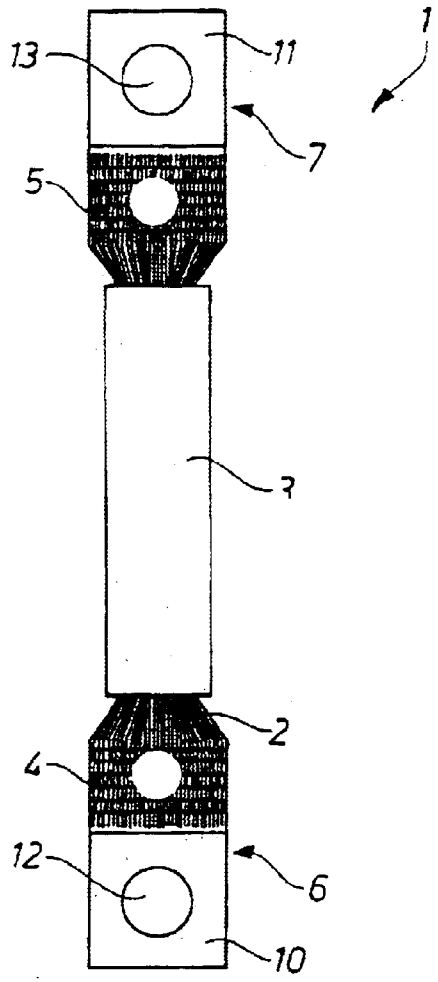
FIG. 2 is a top view of the battery terminal connecting cable as in FIG. 1

The battery terminal connecting cable 1 shown in FIGS. 1 and 2 essentially consists of a strand 2 comprising numerous fine wires surrounded in a central region by some insulation 3. At both ends the strand 2 is pressed together to form a flattened end or further section 4 or 5. At this flattened end there is welded a contact piece 6 or 7. The contact pieces 6 or 7 exhibit a region 8 or 9 of reduced thickness where the flattened part or further section 4 or 5 of the strand 2 is welded on by means of an ultrasound welding method. The reduced-thickness section 8 of the contact piece 6 is followed by a somewhat thicker region 10 or 11 having a central hole 12 or 13. The holes 12 or 13 are used to secure the contact piece to a battery terminal (not shown) via a screw inserted in the hole. Further section 4 or 5 can also have a hole for allowing a screw to fit there through.

The regions 4 or 5 of the strand 2 are at least partially relatively homogeneous as a result of the welding process since the numerous fine wires in this region are fused to form a solid metal piece. In the present case the wires and the contact piece are made of copper. However, the contact piece in particular can also be made of brass.

Figure 3:
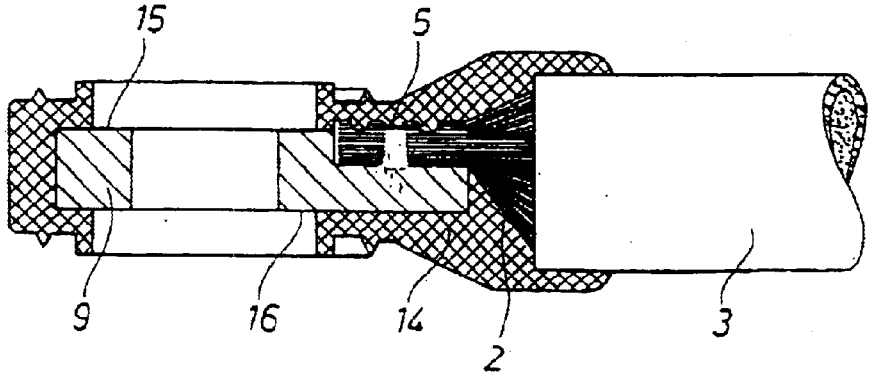
FIG. 3 is a section through one end of a battery terminal connecting cable with plastic sleeving.
Figure 4:
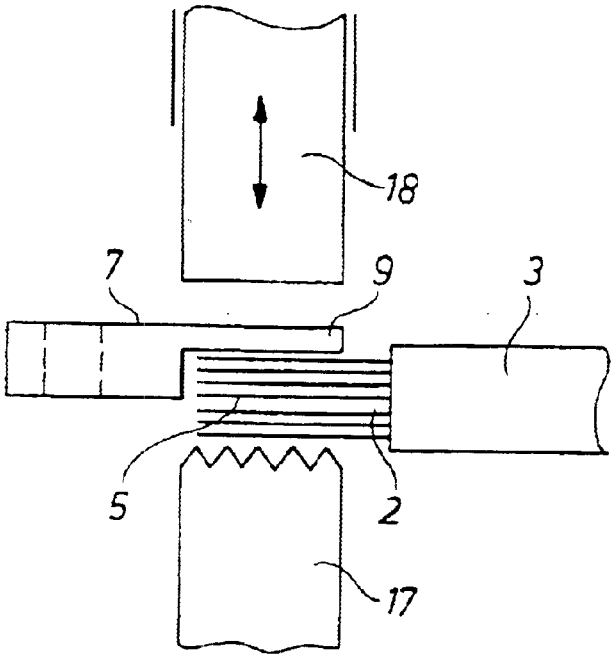
FIG. 4 is a schematic side view of a device for manufacturing a battery terminal connecting cable.

Then, as shown in FIG. 3, the ends of the battery terminal connecting cable thus prepared have an insulating material 14 moulded on by a known method. The strand 2 and more especially its ends 5 are thereby completely surrounded with insulating material. On the upper side 15 of the contact piece 7 there is provided a contact surface for the screw head (not shown) and on the lower side (16) of the contact piece 7 there is provided a contact surface for fitting the contact piece 9 to a battery terminal (not shown).

In order to manufacture the battery terminal connecting cable the end 5 of the strand 2 of numerous fine wires is placed on a titanium sonotrode 17 and the contact piece 7 is positioned on top of this such that the end 5 is adjacent to the narrower region 9 of the contact piece 7. Then a cylinder 18 is pressed towards the sonotrode 17 under pressure so that the narrower end 9 of the contact piece 7 and the end 5 of the strand of fine wires are pressed together between the cylinder 18 and the sonotrode 17. During the pressing process on the one hand, the fine wires of the end 5 are welded together by means of the sonotrode and on the other hand, they are welded simultaneously to the contact piece.

Figure 5:
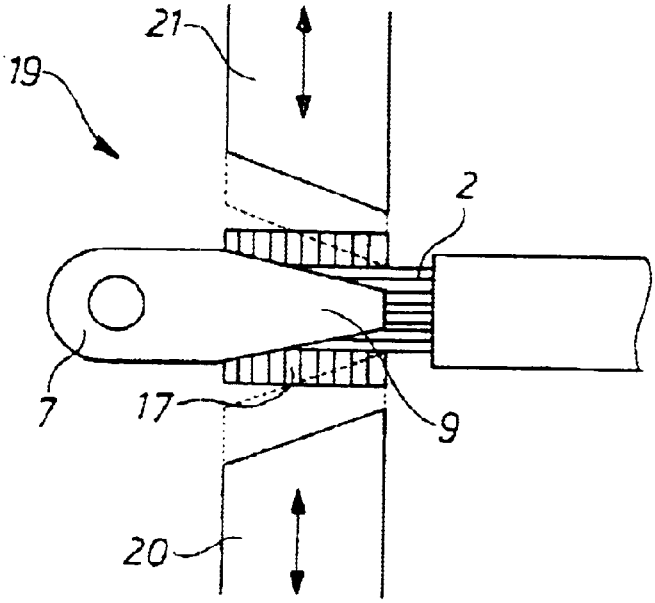
FIG. 5 is a schematic top view of the device as in FIG. 4.
Figure 6:
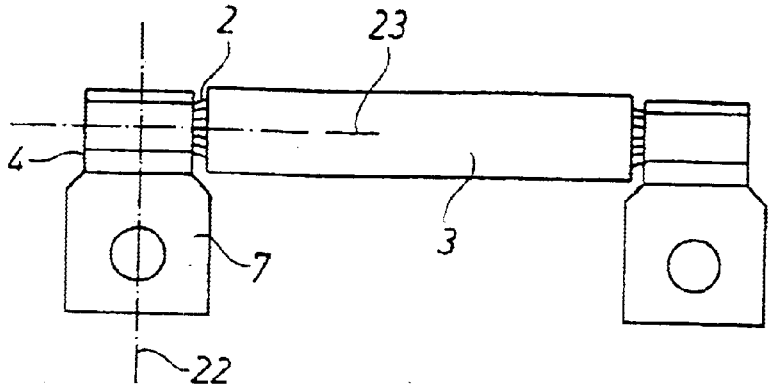
FIG. 6 is a top view of a battery terminal connecting cable with a further section at right angles to the cable axis.

The top view of the entire device 19 shown in FIG. 5 shows the movable jaws 20 and 21 which are moved towards the strand 2 before the contact piece 7 and the strand 2 are pressed together so that when the wires are pressed together by means of the pressure cylinder 18 the individual wires cannot be deflected sideways. In order to achieve optimum contact between the wires of the strand 2 and the contact piece 7, the shape of the jaws 21 and 22 is matched to the shape of the narrower end 9 of the contact piece 7.

The entire work process can easily be automated, as shown in the aforesaid embodiments, by guiding the strand 2 with a strand feed device (not shown) and the contact piece 7 with a contact piece feed device (not shown) towards the sonotrode 17 and then holding them there by means of the jaws 20 and 21 and the cylinder 18 whilst the sonotrode 17 welds the wires of the strand 2 with the contact piece 7. Then the holding devices 18, 20 and 21 are loosened, the ready welded battery terminal connecting cable is removed and the next sections are fed in. The ends of the removed battery terminal connecting cable are then surrounded with an insulating layer 14, as shown in FIG. 3.

The method described can be used for the fast and automated manufacture of battery terminal connecting cables and improves the quality of the cables because the homogeneous binding of the individual wires together prevents any, loosening of the battery terminal screw used. More accurate, calculations also allow the quantity of metal used, more especially the quantity of copper used to be reduced.

FIGS. 6 to 9 show various variants of the configuration of the contact piece 7 on the cable strand 2. The further section 4 together with the contact piece 7 has a longitudinal extension in the direction of the axis 22 which in the present case runs at an angle of 90° to the longitudinal axis 23 of the cable strand 2.

Figure 7:
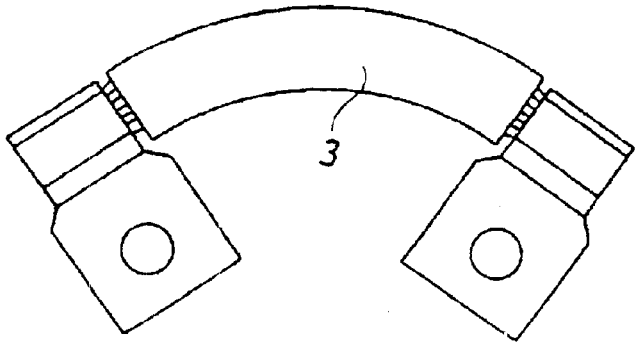
FIG. 7 is a schematic of the battery terminal connecting cable as in FIG. 6 in a curved embodiment.

More especially, if the cable strand 2 is bent as shown in FIG. 7 or in the opposite direction, particularly favourable possibilities are obtained for the connection of two battery terminals.

Figure 8:
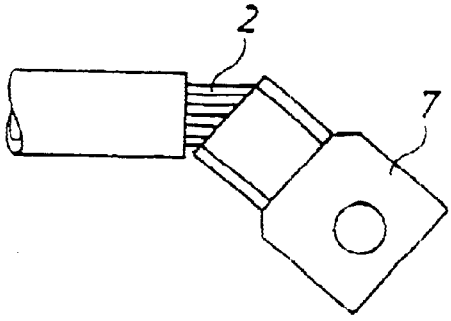
FIG. 8 is a first variant of a further section configured at an angle of approximately 45° and FIG. 9 is a second variant of a further section configured at an angle of approximately 45°.
Figure 9:
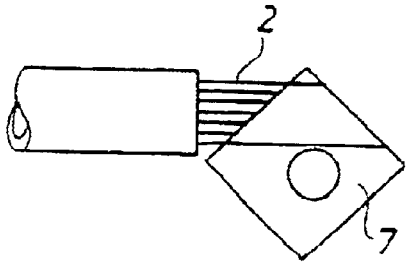

FIGS. 8 and 9 show two different possibilities for welding the individual cables to the contact piece at an angle. Whereas in FIG. 8 the strand end 2 is bent in the direction of the profile of the contact piece 7, in the example of embodiment in FIG. 9 the wires of the strand 2 run in the direction of the axis 23 of the strand 2 and thus at an angle to the longitudinal axis 22 of the contact piece 7.

What is claimed is:

1. A battery terminal connecting cable comprising:

a) a strand comprising a plurality of fine wires, and having a further section formed when said plurality of fine wires are pressed together and, wherein said plurality of fine wires are welded together in said further section;

b) an insulator disposed over a central region of said strand adjacent to said further section;

c) a flat contact piece coupled to only one side of said further section, wherein said further section is disposed at an end of said strand wherein said further section is formed on said end of said strand by pressing said plurality of fine wires together; and said further section is welded to said contact piece.

2. The battery terminal cable as in claim 1, wherein said further section is made from copper.

3. The battery terminal cable as in claim 1, wherein said further section extends longitudinally at an angle to a longitudinal axis of the cable.

4. A battery terminal connecting cable consisting of:

a) a strand cable comprising a plurality of fine wires, and having a further section formed when said plurality of fine wires are pressed together and, wherein said plurality of fine wires are welded together in said further section;

b) an insulator disposed over a central region of said strand adjacent to said further section;

c) an additional insulator disposed over said further section;

d) a flat contact piece coupled to only one side of said further section, wherein said further section is disposed at an end of said strand wherein said further section is formed on said end of said strand by pressing said plurality of fine wires together, and said further section is welded to said contact piece.

5. A battery pole connection cable comprising:

a) a stranded cable formed from a plurality of fine wires, wherein the stranded cable is at least partially insulated; and b) a contact piece for an attachment of said battery pole connecting cable to a battery pole and as a predefined end of said battery pole connecting cable wherein said contact piece is a flat plate having a screw hole, wherein said plurality of fine wires are welded on said contact piece.

* * * * *